United States Patent [19]

Marko et al.

[11] Patent Number: 4,628,322

[45] Date of Patent: Dec. 9, 1986

[54] LOW PROFILE ANTENNA ON NON-CONDUCTIVE SUBSTRATE

[75] Inventors: Paul D. Marko, Pembroke Pines; Thomas F. Kneisel, Davie; Oscar M. Garay, N. Lauderdale, all of Fla.

[73] Assignee: Motorola, Inc., Schaumburg, Ill.

[21] Appl. No.: 840,109

[22] Filed: Mar. 17, 1986

Related U.S. Application Data

[62] Division of Ser. No. 596,747, Apr. 4, 1984, Pat. No. 4,684,585.

[51] Int. Cl.[4] ..... H01Q 1/24; H01Q 1/48

[52] U.S. Cl. ..... 343/702; 343/834; 343/846

[58] Field of Search ..... 343/702, 742, 829, 830, 343/834, 845, 846

[56] References Cited

U.S. PATENT DOCUMENTS 3,184,746 5/1965 Chatelain ..... 343/742

3,757,342 8/1973 Jasik et al. ..... 343/738

*Primary Examiner*—Eli Lieberman

*Attorney, Agent, or Firm*—Daniel K. Nichols; Joseph T. Downey; Mark P. Kahler

[57] ABSTRACT

A low profile antenna comprised of a driven element and a parasitic element spaced above a ground plane. The driven element is connected at one end to the feedpoint of the radio device to which it is attached, the opposite end thereof being free. The parasitic element is connected to the ground plane by its end nearest the feedpoint, the opposite end thereof being free. In the preferred embodiment the parasitic element length and the driven element length are both approximately equal to a quarter wavelength at the operating frequency.

4 Claims, 6 Drawing Figures

Fig. 3
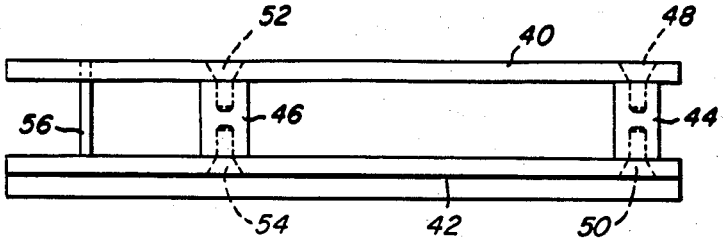
Fig. 4
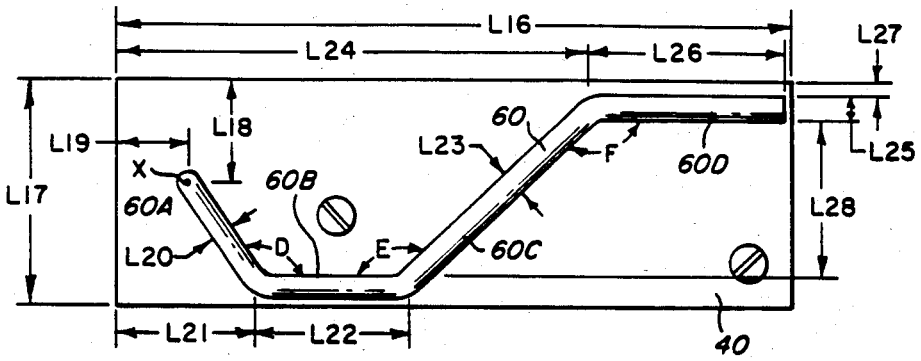
Fig. 5
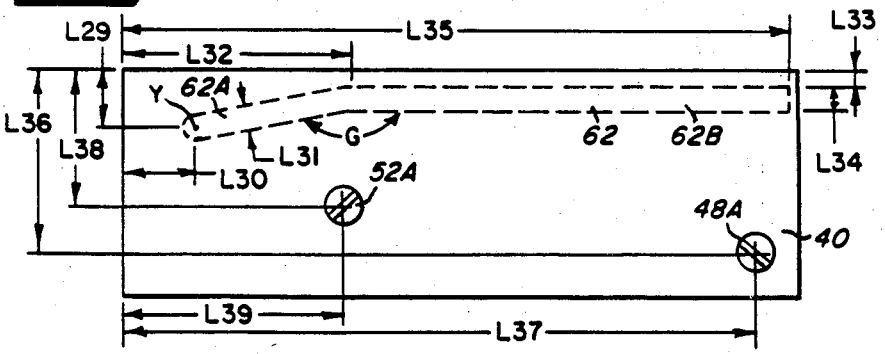
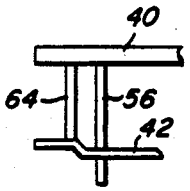
Fig. 6

LOW PROFILE ANTENNA ON NON-CONDUCTIVE SUBSTRATE

This is a division of application Ser. No. 596,747, filed Apr. 4, 1984 now U.S. Pat. No. 4,684,585.

BACKGROUND OF THE INVENTION

1. Field of the Invention

The present invention relates to antennas and more particularly to a low profile antenna which is small in size, simple in construction and high in efficiency.

2. Description of the Prior Art

In the past, many portable radio devices and associated equipment have employed external whip antennas for transmitting or receiving purposes. Unfortunately, such antennas when mounted normal to a surface tend to significantly increase overall dimensions of the portable radio device of which it is a part, which may be a prohibiting factor especially when compactness is a primary consideration. Furthermore, the external whip antennas usually extend out from the radio device in an awkward, cumbersome manner, thus causing a substantial increase in the overall longitudinal dimensions of the radio device.

In an effort to reduce the overall height of vertical antennas, such antennas are often compressed into helical antennas. Unfortunately, although such helical antennas exhibit a reduced overall vertical dimension, they are not as efficient as their full size vertical counterparts.

Further, the copending application entitled Two Element Low Profile Antenna, Ser. No. 489,894 having a filing date of Apr. 29th, 1983 discloses an antenna configuration which provides a more compact low profile antenna. The low profile antenna disclosed therein comprises a counterpoise of electrically conductive material and a passive element oriented substantially parallel thereto. The ends of the passive element are electrically coupled to the counterpoise surface. The active element is made of electrically conductive material and includes a middle portion and first and second outer end portions. The middle portion is situated adjacent and spaced apart from the passive element by a predetermined distance and in a parallel relationship therewith. The first outer end portion of the outer element is bent toward the grounded end of the passive element nearest thereto. The first outer end portion represents the feed point of the antenna with respect to the counterpoise. The remaining second outer end portion of the active element is bent towards the remaining end of the passive element nearest thereto and is electrically coupled to the counterpoise surface. The first and second outer portions by virtue of the bends which orient them close to the ends of the passive element result in coupling substantial electromagnetic energy between the active element and the passive element. For this antenna the critical coupling required for impedance matching occurs at the low impedance points which are at both ends of the antenna in the sections perpendicular to the counterpoise, the critical coupling being induced by the magnetic field. Further, both of the antenna elements are approximately one-half wave length long at the selected operating frequency.

SUMMARY OF THE INVENTION

Accordingly, one object of the present invention is to provide a novel low profile antenna which is suitable for surface mounting with a minimum increase in the longitudinal dimension of the device to which it is attached.

Another object of the present invention is to provide a low profile antenna which is simple in construction and which may be readily tuned.

Still another object of the present invention is to provide a low profile antenna with both of the antenna elements approximately a quarter wave length long at the operating frequency.

The above and other objects and advantages of the present invention are provided by a low profile antenna comprised of a driven element and a parasitic element spaced above a small rectangular ground plane. The driven element is connected at one end to the fifty ohm feedpoint, while the other end of the driven element is free. The parasitic element is connected to the rectangular ground plane at the end nearest the feedpoint, while the other end of the parasitic element is free. In the preferred embodiments the parasitic element length is approximately one quarter the wave length at the high frequency cut-off of the operational band, while the driven element length is approximately one quarter the wave length at the low frequency cut off of the operational band.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings:

FIG. 3 is a side view of a second embodiment of the present invention;

FIG. 4 is a top view of the top side of the embodiment illustrated in FIG. 3;

FIG. 5 is a top view of the bottom side of the embodiment illustrated in FIG. 3;

FIG. 6 is an end view of the embodiment illustrated in FIG. 3.

DESCRIPTION OF THE PREFERRED EMBODIMENTS

Figure 1:
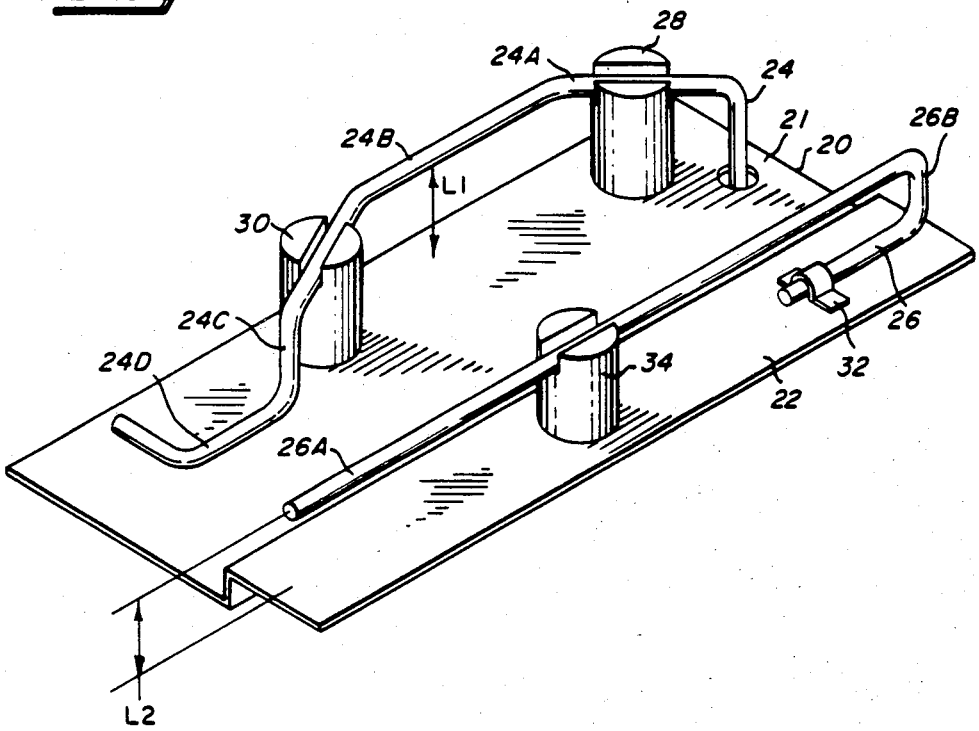
FIG. 1 is a perspective view of a first embodiment of the present invention.
Figure 2:
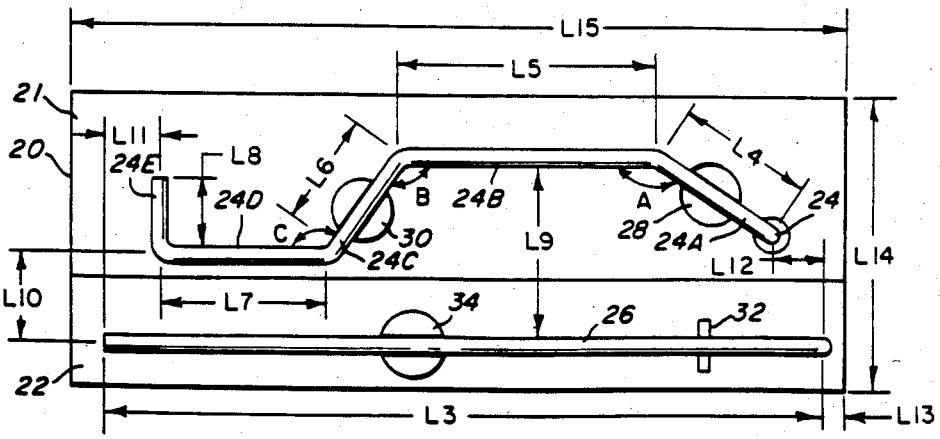
FIG. 2 is a top view of the embodiment illustrated in FIG. 1.

Referring now to the drawings, wherein like reference numerals designate identical or corresponding parts throughout the several views, and more particularly to FIGS. 1 and 2 thereof, a low profile antennna according to the present invention is illustrated. The low profile antenna comprises a rectangularly shaped ground plane 20 having a first mounting area 21 and a second mounting area 22 slightly raised from the first mounting area 21. The ground plane 20 is made of a 0.010 inch thick nickel silver plate first coated with copper having a thickness of 0.0005 inches and then coated with tin also having a thickness of 0.0005 inches. It should also be noted that any metallic plate having good conductivity or coated with any combination of metallic coatings typically used to enhance the conductivity of metal at RF frequencies could be used.

The low profile antenna is designed to have an operational bandwidth from 830 to 880 MHZ and further comprises an active element 24 constructed of a 0.052 inch diameter steel wire, first coated with 0.001 inches copper and then 0.001 inches of tin in order to provide element rigidity and conductivity. It should also be noted that any metallic wire demonstrating sufficient rigidity and conductivity could be used. The active element 24 includes a first end portion 24A, a mid-portion 24B and a second end portion comprised of segments 24C, 24D and 24E. All of the aforesaid portions are oriented substantially parallel to the ground plane 20 and are spaced thereabove by the distance L1. In the first embodiment of the invention, the distance L1 is 0.295 inches. A portion of the first end portion 24A is perpendicular to the remaining portion of the first end portion 24A and the ground plane 20 and extends therethrough in order to be connected to the feedline of the radio device in which the antenna is being used.

The mid-portion 24B extends away from the first end portion 24A at an angle A which is 144 degrees in the first embodiment. The first segment 24C extends away from the mid-portion 24B at an angle B which is 126 degrees in the first embodiment. The second segment 24D extends away from the first segment 24C at an angle C which is 126 degrees in the first embodiment. The last segment 24E extends away from the second segment 24D at a right angle.

The low profile antenna further comprises an L-shaped passive element 26 constructed of the same electrically conductive material as the active element 24. The leg 26A of the passive element 26 is spaced a distance L2 from the mounting surface 22 of the ground plane 20. In the first embodiment the distance L2 is 0.295 inches. The length of the passive or parasitic element 26 is effectively a quarter wave length at the high frequency cut off of the operational bandwith, which in the first embodiment is a length L3 equal to 2.862 inches.

The first end portion 24A of the active element 24 has a length L4 equal in the first embodiment to 0.626 inches. The mid-portion 24B of the active element 24 has a length L5 equal to 0.948 inches. The first segment 24C of the second end portion has a length L6 which is equal to 0.621 inches. The second segment 24D of the second end portion has a length L7 which is 0.740 inches, while the last segment 24E of the second end portion has a length L8 which is equal to 0.225 inches. The mid-portion 24B of the active element 24 is spaced a distance L9 from the parasitic element 26 which is equal to 0.648 inches. The second segment 24D of the second end portion is spaced a distance L10 from the parasitic element 26 and is equal to 0.170 inches. The free end of the active element 24 terminates a distance L11 before the termination of the free end of the parasitic element 26 and in this first embodiment is a distance of 0.300 inches. The first end portion 24A of the active element 24 begins a distance L12 more inward from the right edge of the ground plate 20 than the rightmost end of the passive element 26 and is equal to 0.244 inches in the first embodiment. The right-most end of the passive element 26 begins at a distance L13 from the rightmost edge of the ground plate 20 which is a distance of 0.150 inches. The width L14 of the ground plate 20 is equal to 1.10 inches, while the length L15 of the ground plate 20 is equal to 3.165 inches. It should also be noted that the mounting fixture 28 for the active element 24 has its rightmost edge 1.30 inches from the feed point of the active element 24 and is 0.260 inches in diameter. The second mounting fixture 30 is also 0.260 inches in diameter and has its rightmost edge 0.135 inches from the juncture of the first segment 24B of the second end portion with the second segment 24C. The third mounting fixture 34 for the passive element 26 has its rightmost end starting 1.30 inches from the end of the passive element 26 which is fixed to the second mounting surface 22 of the ground plate 20. Again, the third mounting fixture 34 is 0.260 inches in diameter.

Assuming the current on the driven element 24 is approximated as that which exists on a quarter wavelength stub, the operational characteristics of the antenna will be described hereinafter. The driven or active element 24 is effectively a resonant quarter wave at the low frequency end of the operational bandwidth which in this embodiment is 830 MHZ. Conversely, the parasitic element 26 is effectively a resonant quarter wave element at the high frequency end of the operational bandwidth which in this embodiment is 880 MHZ. The second end section 24D of the driven element 24 provides high impedance coupling to the parasitic element and also minimizes the reactance in the frequency range between the effective element resonances. This electric field induced coupling is critical to the broadband impedance characteristics of the antenna. The segment of the first end portion 24A which is perpendicular to the ground plate 20 provides for low impedance (magnetic field induced) coupling with the segment 26B of the parasitic element 26. Thus, the parasitic element 26 and the active element 24 with the associated spacings therebetween act as a transformer to step up the impedance of the entire antenna structure to 50 ohms. The separation of the first end section 24A which is parallel to the ground plate 20, the mid-section 24B and the first segment 24C of the second end portion from the parasitic element 26, provides isolation of the high and low impedance coupling sections with respect to the parasitic element.

It should be noted that the antenna described above is designed to operate inside a 0.090 inch thick dielectric housing having a dielectric constant of 3.3. The housing provides the proper loading for the antenna. However, with proper modifications to the dimensions, the antenna will operate in a multiplicity of environments, including free space.

Referring now to FIGS. 3 through 6, the second embodiment of the present invention is illustrated. In this embodiment the antenna is designed to have an operational band width from 830 MHZ to 880 MHZ and is formed on both sides of a printed circuit board 40 which is spaced from the ground plate 42 by way of the dielectric spacers 44 and 46 which are secured by way of the mounting screws 48 and 50, and 52 and 54 respectively. The driven element of the antenna is connected to a 50 ohm feed by way of the connecting member 56 which is preferably made of a base metal which is plated with copper and then tin.

Referring now to FIG. 4, the antenna elements are mounted on a printed circuit board 40 which has a length L16 of 3.180 inches, a width L17 of 0.902 inches, a thickness of 0.032 inches and a relative dielectric constant of 4.6. The driven element 60 is comprised of a first end portion 60A, a first mid-portion 60B, a second mid-portion 60C, and a second end-portion 60D. The first end-portion 60A has one end connected to the connecting wire 56 at a position L18 from the top edge of the printed circuit board 40 and L19 from the left edge of the printed circuit board 40. In the second embodiment the distance L18 is 0.445 inches and distance L19 is 0.392 inches. The width L20 of the first end-portion 60A of the driven element 60 is 0.135 inches. The other end of the first end portion 60A is located a distance L21 from the left edge of the printed circuit board 40 and in the second embodiment is 0.765 inches. The length L22 of the first mid-portion 60B of the driven element 60 is equal to 0.840 inches in the second embodiment. The second mid-portion 60 C of the driven element 60 has a width L23 of 0.137 inches in the second embodiment and ends a distance L24 from the leftmost edge of the printed circuit board 40 which in the second embodiment is equal to 2.226 inches. The second end portion 60D of the driven element 60 has a width L25 of 0.148 inches and has a length L26 of 0.944 inches. The outer edge of the second end portion 60D is spaced a distance L27 from the top edge of the printed circuit board 40 and in the second embodiment L27 is equal to 0.037 inches. The inner edge of the second end portion 60D is spaced a distance L28 from the inner edge of the first mid-portion 60B and in the preferred embodiment is equal to 0.563 inches.

The first mid-portion 60B extends from the first end portion at an angle D which is 136 degrees in this second embodiment. The second mid-portion 60C extends from the first mid-portion 60B at an angle E which is equal to 132 degrees in the second embodiment. The second end portion 60D extends from the second mid-portion 60C at an angle F which is equal to 132 degrees in the second embodiment.

Referring now to FIG. 5 the bottom side of the printed circuit board 40 is illustrated. The bottom side of the printed circuit board 40 contains the metallization pattern for the parasitic element 62 which includes the first end portion 62A and the second end portion 62B. The center point V of the end of the first end portion 62A of the parasitic element 62 is located a distance L30 from the left end of the printed circuit board 40 and in the second embodiment L30 is equal to 0.392 inches. The aforesaid center point V is also located a distance L29 from the top edge of the printed circuit board 40 which in the second embodiment is 0.240 inches. The width L31 of the first end portion 62A is equal to 0.123 inches in the second embodiment. The second end portion 62B of the parasitic element 62 begins a distance L32 from the left edge of the printed circuit board 40 which is equivalent to 1.110 inches in the second embodiment. The angle G between portions 62A and 62B is equal to 169 degrees. The outer edge of the second edge portion 62B is located a distance L33 from the upper edge of the printed circuit board 40 and is equal to 0.033 inches in the second embodiment.The width L34 of the second end portion 62B of the parasitic element 62 is equal to 0.123 inches in the second embodiment. The right end of the second end portion 62B is located a distance L35 from the left edge of the printed circuit board 40 and in the second embodiment is equal to 3.170 inches. The center of the aperture 48A for receiving the fastening screw 48 is located a distance L36 from the upper edge of the printed circuit board 40 which in the second embodiment is 0.700 inches. The center of the aperture 48A is also a distance L37 from the left edge of the printed circuit board 40 which in this embodiment is 2.970 inches. A second aperture 52A for receiving the fastening screw 52 has its center located a distance L38 from the upper edge of the printed circuit board 40 which in this embodiment is 0.420 inches and is also located a distance L39 from the left edge of the printed circuit board 40 which in this embodiment is 1.170 inches. The ground plate 42 is 1.13 inches wide, 3.16 long and 0.020 inches thick in the second embodiment.

Referring now to FIG. 6, the connector 56 connects the feed point of the driven element to the 50 ohm feed line of a radio device and the conductive connecting member 64 connects the first end portion 62A of the parasitic element to the ground plate 42. The conductive connecting member 64 is made from a base metal first coated with copper and then with tin. The connecting member 64 maintains a space of 0.370 inches between the top surface of the ground plate 42 and the bottom surface of the printed circuit board 40.

The operation of this embodiment is essentially the same as that of the first embodiment with the exception that the high impedance coupling is attributable to both the amount of overlap between the second end portion of 60B of the driven element and the second end portion 62B of the parasitic element 62 and the thickness of the substrate 40.

Obviously, numerous (additional) modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A low profile antenna, comprising:

a non-conductive substrate having a first side and a second side;

a first metallization pattern connected to said first side of said substrate and forming a passive element;

a second metallization pattern, connected to said second side of said substrate and forming an active element;

a ground plate in spaced parallel relation to said substrate; and conductor means, for directly electrically connecting said passive element to said ground plate, said driver element having a first mid-portion, a first end portion extending angularly inward from said first mid-portion to a point constituting the antenna feed point, a second mid-portion extending angularly from said first mid-portion and a second end portion extending from said second mid-portion and overlapping the parasitic element, said antenna having a low impedance coupling between said feedpoint and said passive element ground plate connection and a high impedance coupling between said second end of said driven element and said passive element, attributable to both the amount of overlap of said elements and the thickness of said substrate.

2. The antenna according to claim 1, further comprising:

spacer means, for insulating connecting said substrate to said ground plate.

3. The antenna according to claim 1, wherein said substrate is positioned with its first side facing said ground plate.

4. The antenna according to claim 3, wherein spacer means insulatingly locates said substrate relative to said insulatingly ground plate.

* * * * *